United States Patent [19]

Mayol

[11] 4,040,658

[45] Aug. 9, 1977

[54] FOLDING PICNIC TABLE

[76] Inventor: George Mayol, 512 State St., Mahomet, Ill. 61853

[21] Appl. No.: 605,906

[22] Filed: Aug. 19, 1975

[51] Int. Cl.[2] ..... A47C 3/14

[52] U.S. Cl. ..... 297/159; 108/99

[58] Field of Search ..... 297/159, 157; 108/99, 108/100, 113, 115, 127

[56] References Cited

U.S. PATENT DOCUMENTS

| | | | |
|---|---|---|---|
| 2,722,971 | 11/1955 | Gallagher et al. | 297/157 |
| 2,752,987 | 7/1956 | Smithers | 297/159 |
| 2,811,197 | 10/1957 | Nimmo | 108/99 X |
| 2,936,820 | 5/1960 | Blink et al. | 297/159 |
| 2,992,043 | 7/1961 | Nelson | 297/159 |
| 3,191,991 | 6/1965 | Anderson et al. | 108/99 X |
| 3,273,936 | 9/1966 | Deavers | 297/159 |
| 3,574,393 | 4/1971 | Hughes | 297/157 |

FOREIGN PATENT DOCUMENTS

| | | | |
|---|---|---|---|
| 611,185 | 12/1960 | Canada | 297/159 |

*Primary Examiner*—Roy D. Frazier
*Assistant Examiner*—William E. Lyddane
*Attorney, Agent, or Firm*—David V. Munnis

[57] ABSTRACT

A folding picnic table consisting of a table surface and a pair of seat surfaces, the table surface and seats being supported on side frame members which are mounted to fold inwardly for collapsing the seats in a plane adjacent the top surface, and a pair of wheels affixed to one of the side frame members for use in wheeling the table between desired locations.

1 Claim, 7 Drawing Figures

FOLDING PICNIC TABLE

BACKGROUND OF THE INVENTION

1. Field of the Invention

This invention relates generally to tables and more particularly to a novel and improved folding picnic table.

2. Description of the Prior Art

It has been known in the prior art to provide conventional type dof picnic tables with benches on either side, with a distinctive problem associated therewith being the storage and transportation of such picnic tables which can become quite a sizable problem. In view of such problems, there have been developed in the prior art different types of folding tables along with different types of folding and collapsible chairs, but none of these resemble the conventional picnic table where the seats are affixed to the same side frame braces that support the table top.

SUMMARY OF THE INVENTION

The present invention provides a novel folding picnic table which resembles an ordinary conventional picnic table with benches supported on either side of the table top and resting on the side frame members, however, the side frame members are collapsible to permit folding of the table with there being provided a pair of wheels for use in rolling the table between desired locations.

It is a feature of the present invention to provide a folding picnic table.

A further feature of the present invention provides a folding picnic table which is relatively simple in its construction and which, therefore, may be readily manufactured at a relatively low cost and by readily available manufacturing methods so that it can be retailed at a sufficiently low price to encourage widespread use and purchase thereof.

Yet still a further feature of the present invention provides a folding picnic table which is easy to use and reliable and efficient in operation.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBOIDMENT

Figure 1:
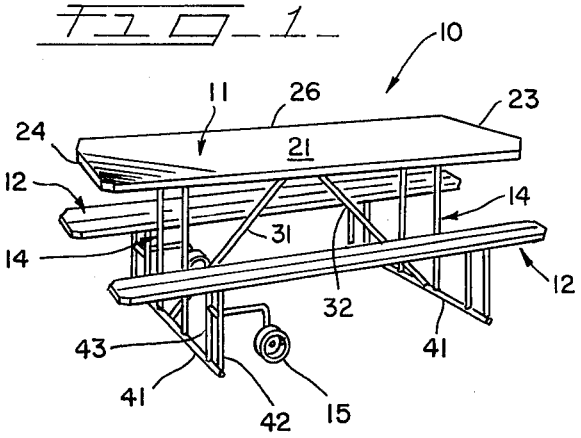
FIG. 1 is a perspective view of the folding picnic table of the invention.
Figure 4:
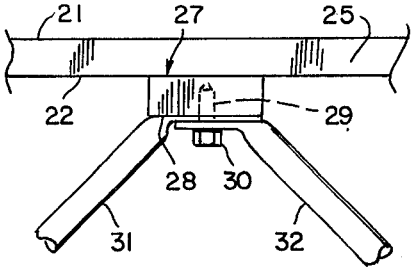
FIG. 4 is a fragmentary front elevational view of the center strut brace and the center struts.

Referring now to the drawings in detail, there is illustrated a preferred form of a folding picnic table constructed in accordance with the principles of the present invention and which is designated generally in its entirety by the reference numeral 10 and which is comprised of a table top 11, a pair of bench seats 12, and a pair of supporting sideframe members 14, each pivotably affixed to the table top 11.

The table top 11 is of an elongated flat rectangular configuration having a top surface 21, a bottom surface 22, opposed end edges 23 and 24 and opposed side edges 25 and 26. It is to be understood that the table top may be manufactured of a single sheet of material or, alternatively, may be manufactured of a series of side-by-side boards. A center strut brace mounting member 27 is affixed centrally of the table top bottom surface 22 and is provided in its bottom surface 28 with a threaded aperture 29 adapted to threadedly receive bolt 30 therin for removably affixing thereto the center struts 31 and 32.

Affixed to table bottom surface 22 adjacent and parallel to each of the end edges 23 ad 24 are a pair of box-shaped mounting blocks 35 and 36 each having pivotably mounted thereto one of the side frame members 14 by means of pivot pin 37. Each of the side frame members 14 are of an inverted T-shape with the arm portion of the T designated by reference numeral 41 and adapted to engage the ground surface, and including vertical members 42 and 43 projecting upwardly therefrom with the side frame members 14 pivotally affixed by pivot pin 37 to blocks 35 or 36. Extending diametrically through each of the members 42 and 43 is an opening 44 adapted to receive therethrough removable pin 45 which extends outwardly from each of the members 42 and 43. Blocks 52 and 53 are secured to the bottom surface of seats 12 adjacent the opposite ends thereof, and, with the table 10 in the opened position, the blocks 52 and 53 are removably rested on and secured to the vertical members 42 and 43 in any conventional manner.

Figure 2:
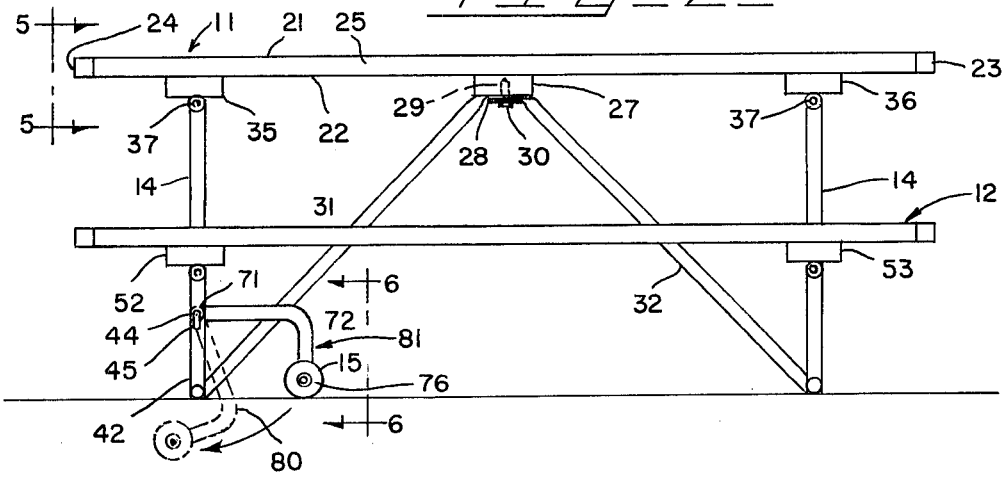
FIG. 2 is a front elevational view of the picnic table of the invention in the open position.
Figure 5:
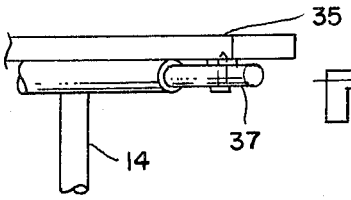
FIG. 5 is a fragmentary front elevational view of the pivot mechanism.
Figure 6:
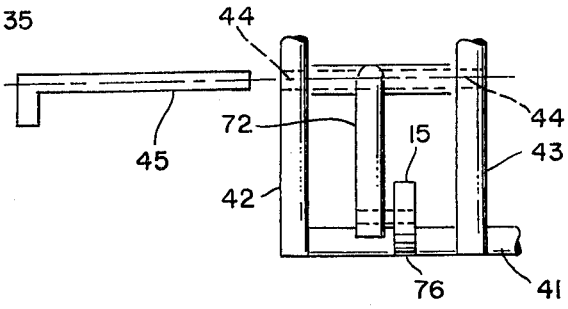
FIG. 6 is a fragmentary and elevational view of the vertical seat support members with the wheel assembly.

Each of the struts 31 and 32 each have one end pivotably affixed to member 41 with the struts extending upwardly and diverging outwardly therefrom to be engaged by bolt 30 when the table is in the open position, such as illustrated in FIG. 2.

A hole 44 is provided in both members 42 and 43 and is used in association with wheel assembly 15. The holes 44 receive the pin 45 through end 71 of an L-shaped mounting bracket 72 having a wheel 76 mounted for rotation at the opposite end thereof.

Figure 3:
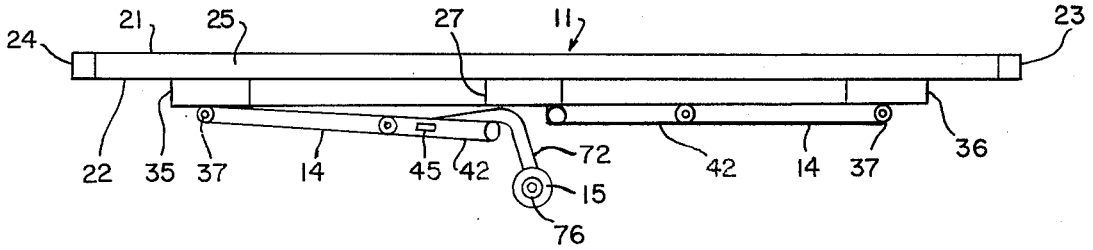
FIG. 3 is a front elevational view of the picnic table in the closed position with the seats removed.
Figure 7:
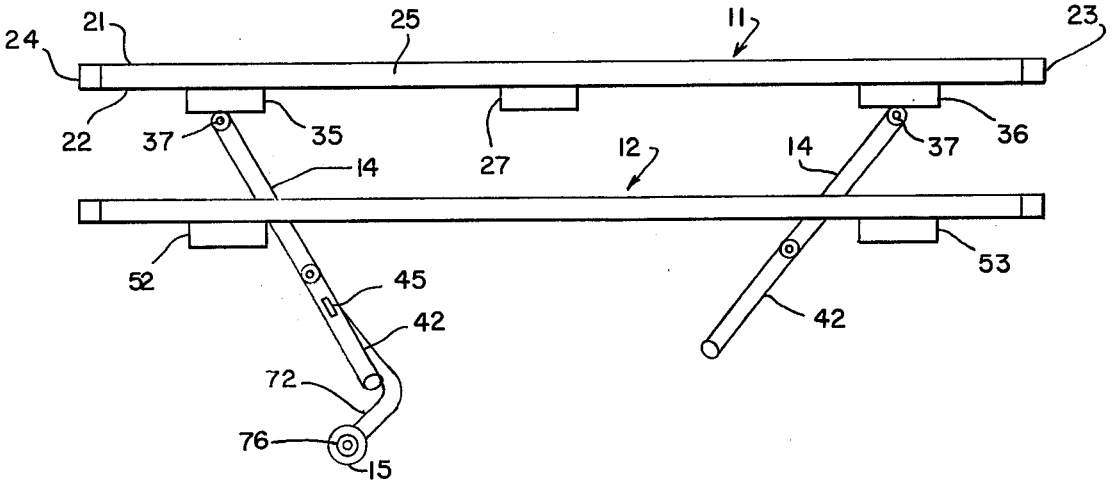
FIG. 7 is a front elevational view of the folding picnic table in a partially collapsed position.

In operation, the picnic table 10 is initially in the folded position of FIG. 3 with the seats 12 removed, and when placed in the open position, the side frame members 14 are swung downwardly relative to table top 11 until disposed in a vertical position, at which time struts 31 and 32 are secured to block 27 by means of bolt 30. Pin 45 is then inserted through holes 44 in members 42 and 43 and through the hole (not shown) provided in the end 71 of the L-shaped mounting bracket 72 so that the wheel assembly 15 is disposed relative to holes 44 in the position designated by the reference numeral 80 in FIG. 2 for ease of rolling the table about, and when the table is at the desired location, the seats 12 are rested on top of the vertical members 42 and 43 by placing blocks 52 and 53 thereon and securing them in place in any conventional manner, and the wheel assembly 15 is shifted to a position designated by reference numeral 81 so that the table firmly rests on side frame members 14.

It is to be understood that the form of this invention as shown and described is to be taken as a preferred example of the invention, and that this invention is not to be limited to the exact arrangement of parts shown in the drawings or described in this specification as various changes in the details of construction as to shape, size, and arrangement of parts may be resorted to without departing from the scope of the novel concept of the invention.

Having thus described the invention, what is claimed is:

1. A folding pinic table comprising, in combination:

a flat table top, a pair of elongated flat bench-type seats, a pair of side frame members, means pivotably mounting the side frame members to the table top, and means for selectively rolling and stabilizing the table, where the table top is of a flat rectangular configuration having a flat top surface, a flat bottom surface, opposed and edges, and opposed side edges, and wherein each of the bench seats are identical in configuration and include a flat top surface, a flat bottom surface, opposed flat end edges, and opposed flat side edges: and each of said side frame members being generally of an inverted T-shaped configuration having their base portion pivotably affixed to the bottom surface of the table top end having their arm portions extending outwardly therefrom to engage the ground surface, and further characterized by a series of vertical members projecting upwardly from the arm portions and adapted to supportingly receive the bench seats thereon with the picnic table in the open position, said vertical members being further characterized by holes therein extending parallel to said arm portions, the holes in adjacent vertical members being aligned in pairs, and wherein further the means pivotably affixing each of said side frame members to said table top being comprised of a pair of mounting blocks each affixed to the bottom surface of said table top and extending transversly thereacross adjacent opposite end edges thereof, and a pivot pin hingedly connecting the base portin of said side frame member to the surface of said block; and a pair of strut members each having one end affixed to the arm portion of one of said side frame members and extending upwardly and outwardly therefrom, a mounting block affixed centrally of the bottom surface of the table top and having a threaded bore opening therefrom, and a bolt adapted to engage the free ends of each of the struts and be threadably received in the threaded opening of said mounting block to removably secure the struts thereto; and said means for selectively rolling and stabilizing the table including a pair of wheels, a pair of L-shaped supporting arms, each wheel having an L-shaped supporting arm associated therewith with the wheel being rotatively mounted to one end thereof, the end of each said L-shaped supporting arm opposite said wheel mounted thereon having a hole extending therethrough parallel to the axis of said wheel and being aligned with a pair of said holes in adjacent vertical members of said side frame members, and pin means removably positioned in said aligned holes of adjacent vertical members and in the hole in each said L-shaped supporting arm to adapt said L-shaped supporting arms for rotatable movement about said pin means and allow said wheels to be selectively positioned between an inoperative storage position and an operative position wherein said table is adapted to be rolled on said wheels.

* * * * *